United States Patent [19]

Schottler

[11] 3,971,259

[45] July 27, 1976

[54] FLUID TRANSDUCER

[76] Inventor: Henry Schottler, SE. Lamon Lane, Fort Pierce, Fla. 33452

[22] Filed: Jan. 2, 1974

[21] Appl. No.: 430,332

[52] U.S. Cl. ..... 74/25; 74/437; 123/44 E; 417/273

[51] Int. Cl.[2] ..... F16H 21/16

[58] Field of Search ..... 74/437; 417/273; 123/55 R, 44, 56

[56] References Cited

UNITED STATES PATENTS

| | | | |
|---|---|---|---|
| 314,221 | 3/1885 | Carnahan | 74/437 |
| 653,058 | 7/1900 | Beggs | 74/437 |
| 1,246,272 | 11/1917 | Hutchinson | 123/55 A |
| 1,790,198 | 1/1931 | Cizek | 123/55 R |
| 2,142,448 | 1/1939 | Maier | 74/437 |
| 2,143,236 | 1/1939 | Birk | 74/437 |
| 2,700,285 | 1/1955 | Bellini | 74/437 |
| 3,077,870 | 2/1963 | Schmid et al. | 123/44 |
| 3,274,982 | 9/1966 | Noguchi et al. | 123/56 |
| 3,678,766 | 7/1972 | Geber | 74/437 |

*Primary Examiner*—Benjamin W. Wyche
*Assistant Examiner*—Wesley S. Ratliff, Jr.
*Attorney, Agent, or Firm*—Melvin F. Jager

[57] ABSTRACT

A fluid transducer including a reciprocatory piston member and a rotary member, and a drive mechanism for converting reciprocation of the piston member into rotation of said rotary member, or vice versa. The drive mechanism includes a first elliptical member rotatable with said rotary member and a second elliptical member rotatably mounted within said transducer and arranged for reciprocation with said piston member. The elliptical members are retained in engagement, and rotate in unison as said piston member reciprocates with respect to said rotary member to transmit motion between said piston and rotary members.

9 Claims, 12 Drawing Figures

FIG. 7
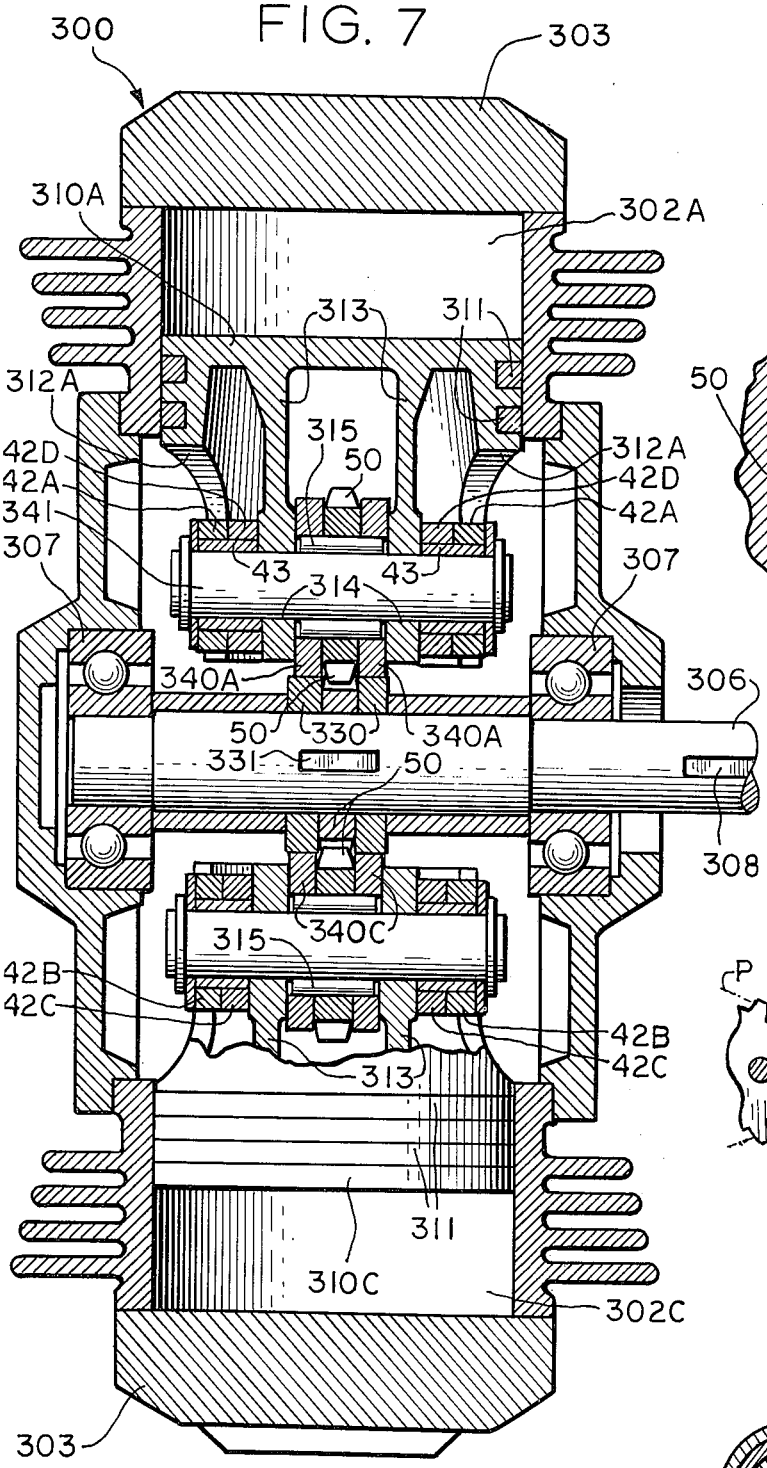
FIG. 8
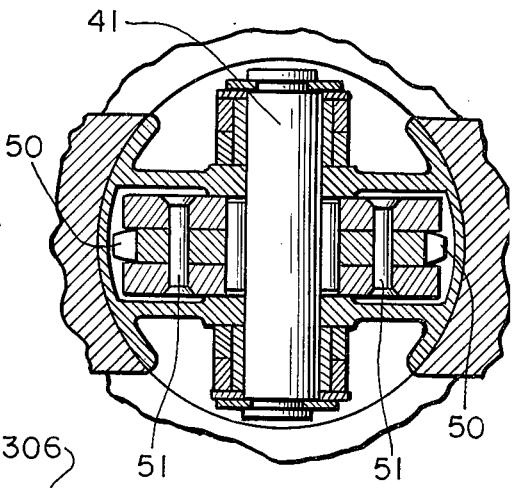
FIG. 10
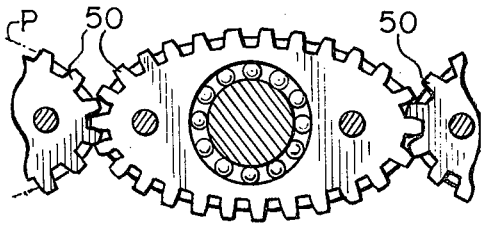
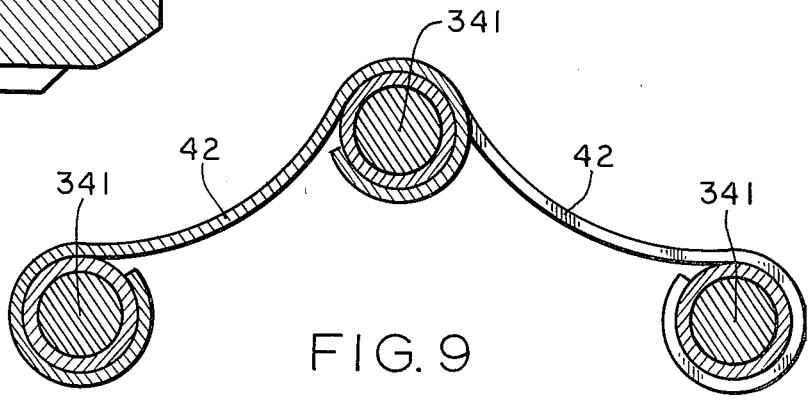
FIG. 9

FIG. 11
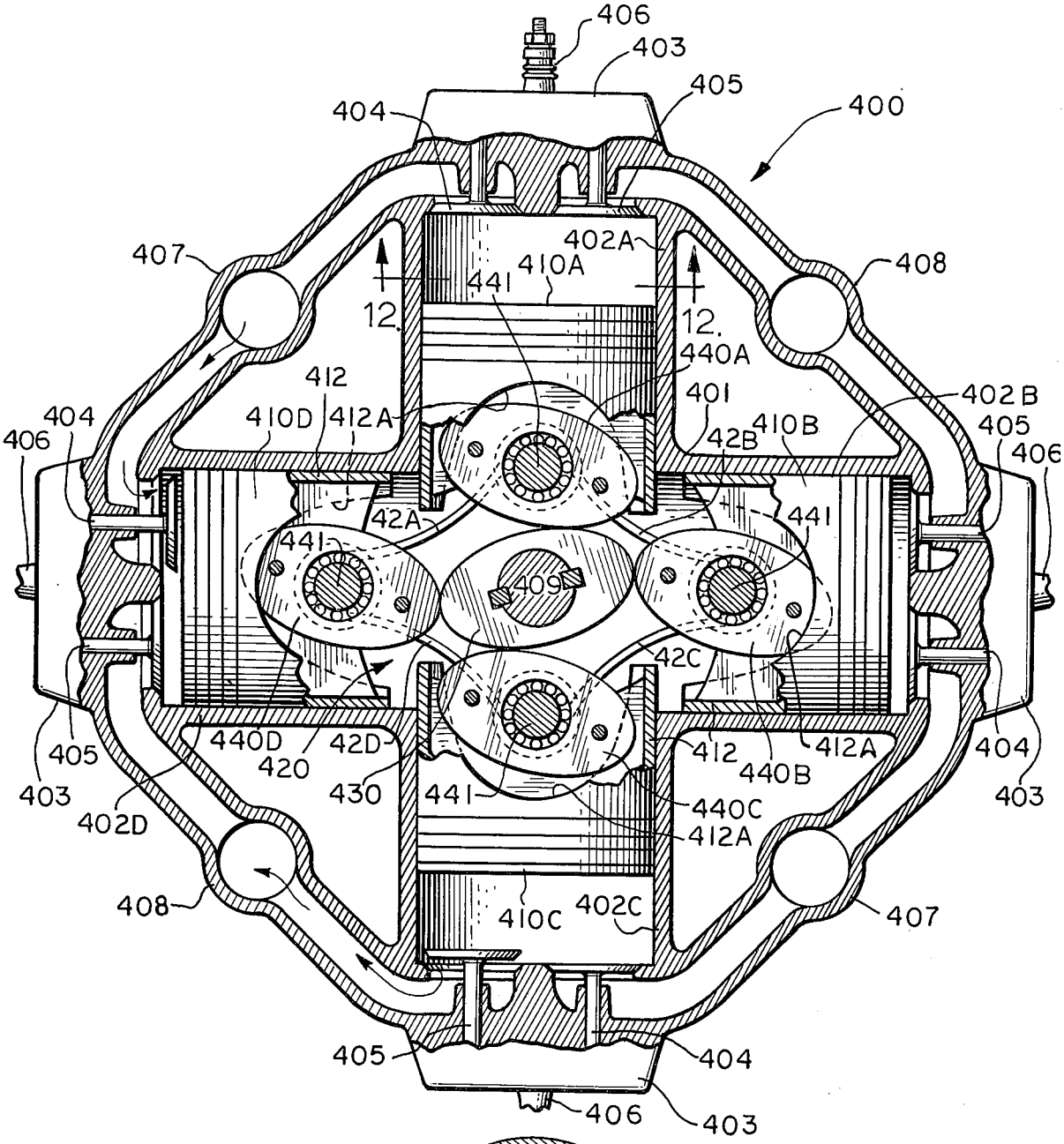
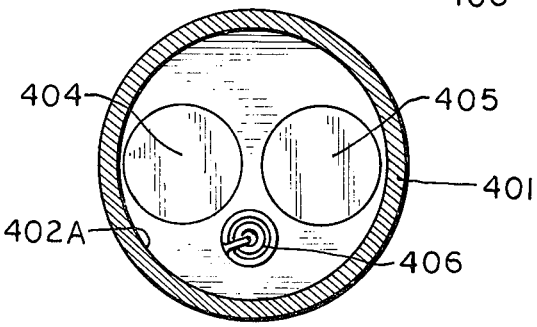
FIG. 12

FLUID TRANSDUCER

GENERAL BACKGROUND AND DESCRIPTION

This invention relates generally to fluid transducers, and more particularly relates to fluid transducers incorporating an elliptical drive mechanism for converting rotary motion into reciprocatory motion, or vice versa. In one form of the invention the transducer can be utilized as an engine or motor to convert fluid-induced reciprocatory motion into rotary motion. In other forms of the invention, the transducer may be utilized as a pump or compressor to convert the rotary motion of a shaft into reciprocatory motion of a piston, to impart energy to a fluid through the motion of the piston.

There is a constant need in the fluid transducer field for an improved drive mechanism for transmitting energy to or receiving energy from a fluid through the efficient conversion of reciprocatory motion in to rotary motion, or vice versa. In standard reciprocating piston mechanism, for example, there are substantial motion and friction losses due to the need for crank shafts, connecting rods and the like.

Many prior attempts have been made to improve upon the standard crank shaft and connecting rod mechanism. For example, cam drive mechanisms have been designed which replace the standard crank shaft and connecting rods with a rotary drive cam and reciprocatory cam roller followers. Many of these prior cam drive mechanisms, however, still produce substantial motion and friction losses when transmitting motion betwen a reciprocating piston and a rotary shaft.

A substantial amount of these losses in prior mechanisms is due to the design of the drive cam and cam followers. Generally, the prior drive mechanisms use specially designed drive cams and circular roller cam followers, or other arrangements, which cause relative acceleration and deceleration and sliding friction to occur between the engaged parts. Such action produces motion and friction losses which decrease the operating efficiency of the drive mechanism.

It is therefore the principal object of this invention to provide an improved transducer drive mechanism which substantially reduces the foregoing motion and friction losses in converting reciprocating motion into rotary motion, or vice versa. According to this invention, the need for standard crank shafts and connecting rods is eliminated, and the problems experienced with earlier cam drive mechanisms are overcome, by providing a novel elliptical drive mechanism wherein the engaged rotary and reciprocatory components of the mechanism are elliptical in configuration. The engagement between the elliptical members in accordance with this invention is rolling contact which is substantially free of sliding friction and motion losses. The design of this invention produces such rolling contact by moving each of the engaged elliptical members with a constant angular velocity which precludes relative acceleration or deceleration of the engaged members.

Briefly described, the elliptical drive mechanism in accordance with this invention includes an elliptical member connected for rotation with a rotary member, such as a rotary input or output shaft. A second elliptical member is rotatably mounted in the transducer so that it is free to rotate, and to simultaneously reciprocate with a transducer piston member. The elliptical members are arranged to engage each other and rotate in unison as the piston reciprocates with respect to the rotary member. In an engine, the rotation of the shaft and the connected elliptical member causes rotation of the other engaged elliptical member in a manner which induces reciprocation of the connected piston. The opposite result occurs when the transducer is adapted for use as a compressor or a pump or the like. In such an arrangement, the reciprocation of the piston member causes the connected elliptical member to reciprocate and rotate, to thereby rotate the other engaged elliptical member and impart a rotary motion to the connected rotary member. Means are also provided in the transducer to maintain the elliptical members in driving engagement and to synchronize the relative rotation of the engaged elliptical members throughout these operations.

EXEMPLARY EMBODIMENT

Additional objects and features of this invention will become apparent from the following description of several embodiments thereof, taken in conjunction with the accompanying drawings, whrein:

FIG. 7 is a cross-sectional elevational view of the compressor taken along the line 7—7 in FIG. 6;

FIG. 8 is a removed and enlarged sectional view of the compressor taken along the line 8—8 in FIG. 6;

FIG. 9 is an enlarged cross-sectional view of a linkage mechanism embodied in the compressor shown in FIGS. 6–8 for retaining the elliptical members in rolling engagement during the operation of the compressor;

FIG. 10 is a removed plan view of a gearing mechanism embodied in the compressor shown in FIGS. 6–9 to synchronize the rotational movement of the elliptical members;

FIG. 11 is a cross-sectional elevational view of an opposed piston internal combustion engine embodying the elliptical drive mechanism of the present invention; and FIG. 12 is a cross-sectional view of a piston cylinder taken along lines 12—12 in FIG. 11.

Figure 1:
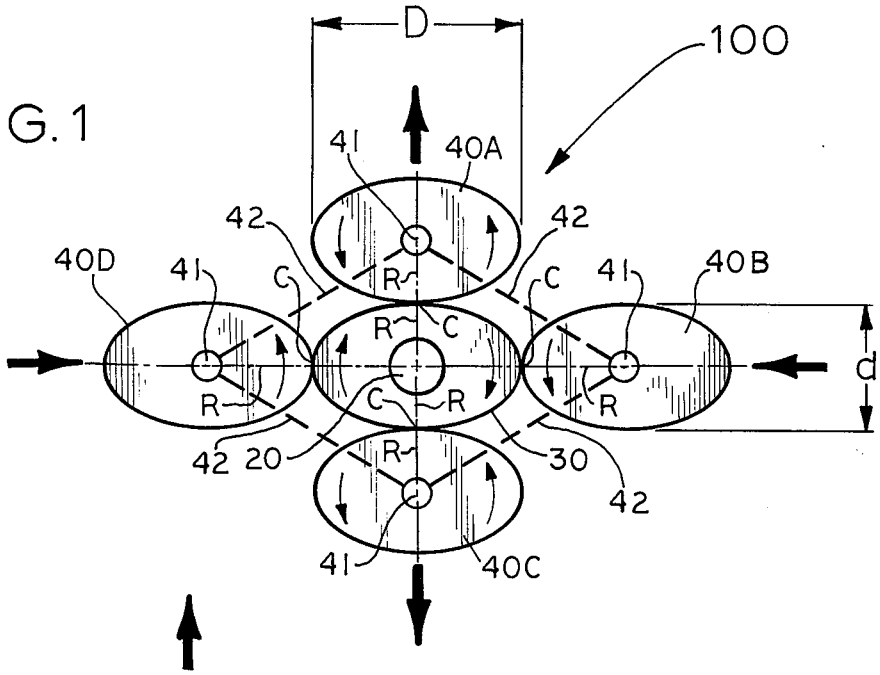
FIG. 1 is a schematic illustration of the elliptical drive mechanism in accordance with this invention at the beginning of an operating stroke.
Figure 2:
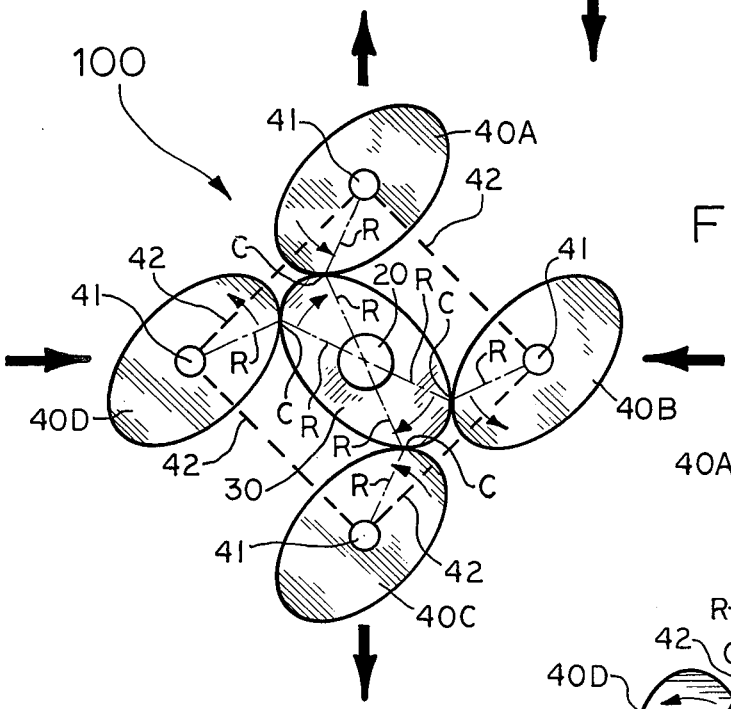
FIG. 2 is a schematic illustration of the elliptical drive mechanism of this invention shown in an intermediate stroke position.
Figure 3:
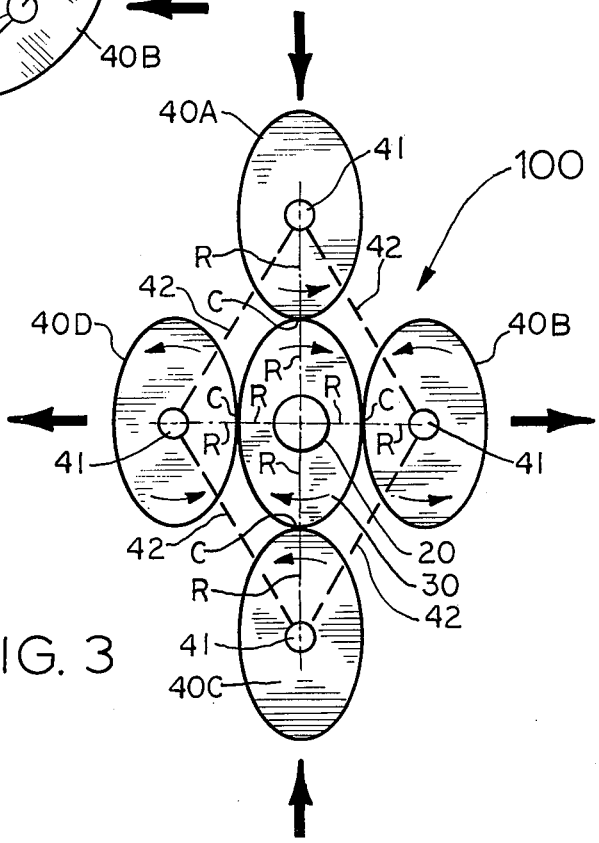
FIG. 3 is a schematic illustration of the elliptical drive mechanism of the present invention shown at the end of an operating stroke.

FIGS. 1–3 of the drawings illustrate the general principles embodied in the drive mechanism in accordance with the present invention. The drive mechanism generally designated by the reference numeral 100, includes a centrally disposed rotary member, such as an input or output shaft 20. A central elliptical member 30 is joined for rotation with the central shaft 20. In an engine, member 30 will be a driving member, and in a pump or compressor, the member 30 will be the driven member. The shaft 20 is connected to the member 30 at the elliptical center-point of the member.

The drive mechanism also includes a plurality of reciprocatory elliptical members 40A-D which are uniformly arranged around the periphery of the rotary member 30. Each of the members 40A-D are mounted in the drive mechanism 100 for rotation about centrally located wrist pins 41. In accordance with this invention, the wrist pins 41 are connected to reciprocatory pistons, or are otherwise guided, so that the pins 41 and the associated members 40A-D reciprocate with respect to the shaft 20, and the members 40A-D simultaneously rotate about their wrist pin 41, during the operation of the drive mechanism 100. To obtain static and dynamic balance, the drive mechanism illustrated in FIGS. 1–3 is designed to be incorporated within a transducer having two pairs of opposed piston members, with the members 40A and 40C, as well as the members 40B and 40D, diametrically opposed about the shaft 20.

Means are also provided in the drive mechanism 100 to retain the reciprocatory elliptical members 40A-D in engagement with the periphery of the rotary elliptical member, and to synchronize the motion of the members, during the operation of the mechanism. In the illustrated embodiment, positive engagement between the elliptical members 30 and 40A–D is accomplished by connecting the adjacent wrist pins 41 with links 42 extended between adjacent wrist pins 41. As seen in FIGS. 1–3, the links 42 are pivotally connected to the wrist pins 41, and permit the associated members 40A–D to rotate about the wrist pins 41 and simultaneously reciprocate with respect to the shaft 20 during the operation of the drive mechanism 100. Each of the links 42 has the same length so that the elliptical centerpoints of the members 40A–D and the wrist pins 41 are spaced by a selected constant distance during the operation of the mechanism 100. As shown in FIG. 9, the links 42 in the illustrated embodiment comprise straps formed from spring steel or the like which is designed to apply an inward biasing force to wrist pins 41. Such an arrangement causes the links 42 to apply an inwardly directed preload force to the members 40A–D that assists in maintaining the members 40A–D engaged with the members 30.

The drive mechanism 100 includes additional means to assure that the relative rotation of the elliptical members 30 and 40A–D is synchronized. As shown in FIG. 10, the synchronization means in the illustrated embodiment comprises elliptical rolling contact gearing 50 provided on each of the elliptical members 30 and 40 A–D. The gearing 50 is arranged so that the rolling engagement of the members 30 and 40 A–D simultaneously causes the gearing on the member 30 to mesh with the gearing on the members 40 A–D. The pitch line of the teeth provided on the elliptical gearing 50 is coincident with the elliptical surface of the associated elliptical member 30 or 40 A–D to assure smooth and quiet meshing of the gearing 50.

In accordance with this invention, each of the elliptical members, such as 30 and 40 A–D, incorporated in the drive mechanism has an elliptical configuration made in accordance with the following standard formula:

$$\frac{X^2}{a^2} + \frac{y^2}{b^2} = 1$$

wherein $2a$ equals the major elliptical diameter; $2b$ equals the minor elliptical diameter; and $x$ and $y$ are the abbsisa and ordinate, respectively of any point on the elliptical surface.

The major diameters (2a) of the elliptical members 30 and 40 A–D is indicated in FIG. 1 to 3 as 'D'; and the minor diameters (2b) as 'd'. The contact points between the member 30 and the members 40 A–D are indicated by the points 'C'. The distance from the rotational centerpoint of each of the elliptical members 30 and 40 A–D to the contact points C is the contact radius indicated as 'R'.

To obtain the maximum features and advantages of the present invention, each of the engaging elliptical members 30 and 40 A–D have identical major and minor diameters D and *d*, and are therefore identical in configuration. In addition, the reciprocatory members 40 A–D are arranged with respect to the rotary member 30 so that the contact points C will be coincident with the aligned major and minor diameters D and *d* during rotation of the engaged members 30 and 40 A–D. Thus, as seen in FIG. 1, during one stage of operation the contact points C between the member 30 and the opposed members 40 A and C will be coincident with the aligned minor diameters *d* of the members 30, 40A and 40C. Likewise, the contact points C between the member 30 and the opposed members 40B and 40D will be coincident with the aligned major diameters D of the members 30, 40B and 40D.

In the position shown in FIG. 1, the contact radius R for the members 40A and 40C is equal to one-half of the minor diameter *d*, and the contact radius R for the members 40B and 40D is equal to one-half the major diameter. This position represents the limits for the inward strokes for the pistons associated with the members 40A and 40C, and the limits of the outward strokes for the pistons associated with the members 40B and 40D. As seen in FIG. 3, this arrangement is reversed upon rotation of the members 30 and 40 A–D by ninety degrees and the completion of a full outward stroke for the pistons associated with the members 40A and 40C, and a full inward stroke for the pistons associated with the members 40B and 40D.

As seen from FIGS. 1–3, the contact radius C for each of the elliptical members 30 and 40 A–D varies from the minor diameter *d* (FIG. 1 for 30, 40A and 40C) to the major diameter D (FIG. 3 for 30, 40A and 40C) during the operation of the drive mechanism 100. As shown by FIG. 2, the contact radius R has a length which is between D and *d* when the members 30 and 40 A–D are in an intermediate position. In accordance with this invention, the arrangement of the members 30 and 40 A–D, and the identical elliptical configuration of the members assures that the contact radius R for the rotary central member 30 is identical to the contact radius R for each of the engaged reciprocatory members 40A–D throughout the operation of the drive mechanism 100. As a result of this invention, each of the elliptical members 30 and 40 A–D rotates about its elliptical centerpoint, on the wrist pin 41, with a selected constant angular velocity.

Because the angular velocity of all of the engaged members 30 and 40 A–D is constant and substantially identical, the members 30 and 40 A–D will rotate without producing any substantial relative rotational acceleration or deceleration between the engaged members 30 and 40 A–D. This substantial elimination of acceleration and deceleration removes the forces from the drive mechanism that would otherwise cause sliding friction and the resulting friction losses between the engaged members 30 and 40 A–D. With this invention, the engagement between the members 30 and 40 A–D will be a rolling frictional engagement, and the losses experienced will be minimum rolling friction losses.

The drive mechanism 100 operates to convert the rotary motion of the shaft 20, and the members 30 into reciprocatory motion of pistons attached to the members 40 A–D, or operates with equal facility to rotate the shaft 20 and the member 30 in response to a fluid force applied to the transducer pistons transmitted through the elliptical members 40 A–D. The operation of the drive mechanism 100, as shown in a transducer adapted as a pump or compressor is begun by rotating the central drive shaft 20 in a clock-wise direction by a suitable external power source (not shown). The rotation of the shaft 20 imparts rotary motion in the same direction to the elliptical member 30. The rotation of the member 30 imparts a comparable rotation to the engaged members 40 A–D. As shown by the arrows in FIGS. 1–3 the members 40 A–D thereby rotate in a counter-clockwise direction about their wrist pins 41. Since the contact radius R for the member 30 and each engaged member 40 A–D remains equal, as the radius varies between diameters D and *d*, the members 30 and 40 A–D rotate with the same angular velocity. As the members 40 A–D rotate in engagement with the member 30, the contact points C on the engaged members change from the initial condition shown in FIG. 1 to an intermediate position shown in FIG. 2.

This relative rotation causes the major diameter D of the member 30 to rotate toward alignment with the major diameter D of the opposed member 40A and 40C. Similarly, the minor diameter *d* of the member 30 rotates toward the minor diameter *d* of the opposed members 40B and 40D. This action causes the members 40A and 40C to reciprocate outwardly with respect to the shaft 20 until the major diameters D of the members 30 and 40A, C are in alignment, as shown in FIG. 3. Simultaneously, the other opposed members 40B and 40D reciprocate inwardly until the minor diameters *d* of the members 30, 40B, D are in alignment. The pistons associated with the members 40A and 40C are thereby driven through an outer compression or pumping stroke, and the pistons associated with the members 40B and 40C are driven through an inward suction or intake stroke.

The length of the piston stroke in the embodiment shown in FIGS. 1–3 is equal to the difference between the major diameter D and the minor diameter *d*. Each of the members 40A–D and their associated pistons will cycle through a complete stroke for each 180° rotation of the shaft 20 and the connected member 30. Each of the pistons will therefore be driven through two complete cycles for each revolution of the shaft 20.

During the above-described operation of the transducer including the drive mechanism 100, the wrist pins 41 are guided for reciprocation by direct connection to pistons or by other suitable guide means. Throughout this operation, the links 42 space the wrist pins 41 a constant distance apart and assist in the synchronization of the relative rotation of the elliptical members 30 and 40A–C. The spring strap link 42 as shown in FIG. 1 also applies an inward pre-loading force to the pins 41 and the connected pistons and elliptical members. The gearing 50, as shown in FIG. 10 continuously mesh as the members 30 and 40A–D rotate in engagement. The gearing 50 assures the synchronized rotation of the members by absorbing tangential loads which may otherwise cause slippage which would alter the relative rotational relationship of the members. The link 42 assists in this synchronization by maintaining the distances between the wrists pins 41 constant and thereby maintaining the gearing 50 in meshing engagement.

Figure 4:
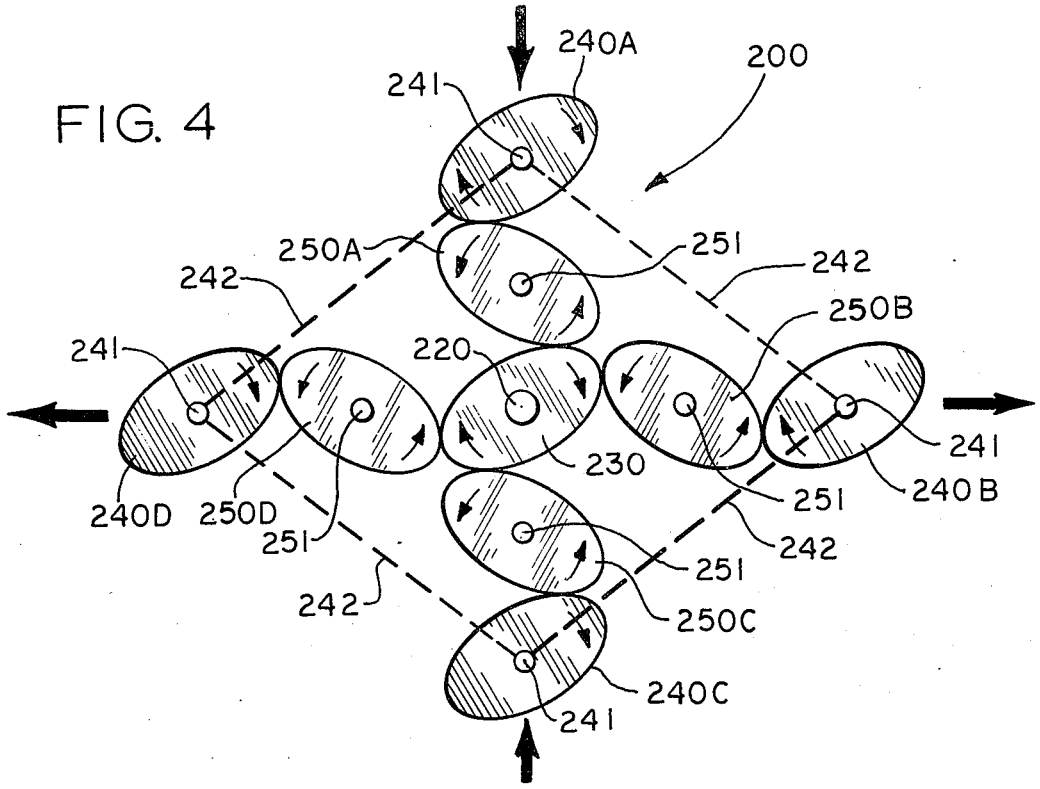
FIG. 4 is a schematic illustration of a modified form of the elliptical drive mechanism in accordance with this invention utilizing multiple elliptical members to increase the distance of the resulting stroke of the associated piston members.
Figure 5:
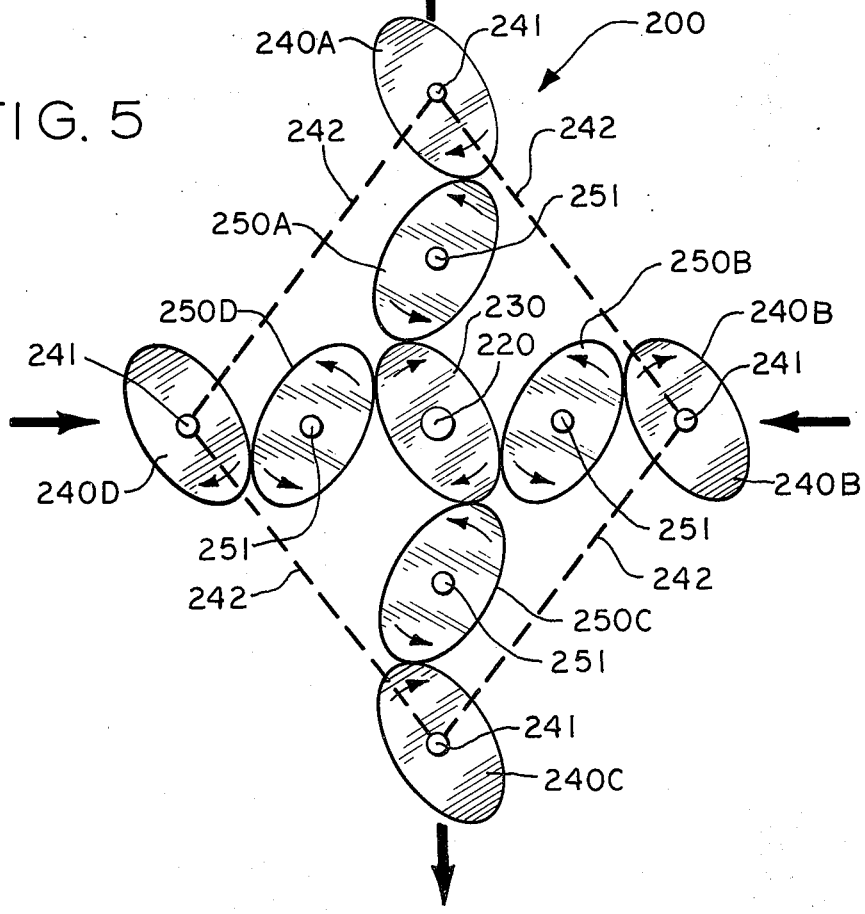
FIG. 5 is a schematic illustration of the modified drive mechanism illustrated in FIG. 4, shown in an advanced operating position.

A modified drive mechanism 200 embodying the features of the present invention is illustrated in FIGS. 4 and 5. The basic principles of operation of the drive mechanism 200 are the same as in the above-described drive mechanism 100. A central rotary shaft 220 includes a rotatable centrally located elliptical member 230. A plurality of reciprocatory and rotatable elliptical members 240A–D are uniformly spaced around the central shaft 220. In a manner similar to the above-described members 40A–D, the elliptical members 240A–D are pivotally connected to centrally located wrist pins 241. The wrist pins 241 are guided, such as by connection to a piston, so that the pins and associated elliptical members reciprocate radially with respect to the shaft 220, and rotate simultaneously during the operation of the drive mechanism 200. Links 242, similar to the above-decribed links 42, connect the wrist pins 241. Moreover, each of the elliptical members 230 and 240 A–D includes the synchronization gearing 50 as illustrated in FIG. 10.

The dimensional relationship and arrangement of the elliptical members 230 and 240 A–D are the same as described above with respect to the elliptical members 30 and 40 A–D in the drive mechanism 100. Furthermore, as seen in FIGS. 4 and 5, the operation of the elliptical members 230 and 240 A–D, for converting rotary motion of the shaft 220 into reciprocation of the pistons associated with wrist pins 241, or vice versa, is the same as described about with respect to the drive mechanism 100.

The modified form of the invention illustrated in FIGS. 4 and 4 includes an additional set of elliptical members 250 A–D interposed between the central member 230 and the members 240 A–D. The second set of elliptical members 250 A–D are mounted for rotation within the transducer drive mechanism 200 upon wrist pins 251. The wrist pins 251 are guided radially in the drive mechanism 200 by suitable means, such as by connection to an extended skirt portion of the associated piston or by radial guide tracks in the transducer. The members 250 A–D, like the members 240 A–D can thereby simultaneously reciprocate and rotate during the operation of the drive mechanism 200. In all other respects, the elliptical members 250 A–D are identical in construction and configuration to the elliptical members 230 and 240 A–D. Each elliptical member 250 A–D also includes the gearing 50 shown in FIG. 10. The engagement of the elliptical members 250 A–D with the central member 230 and the outer members 240 A–D is the same as described about with respect to the members 30 and 40 A–D.

The inclusion of the intermediate members 250 A–D in the drive mechanism 200 increases the length of the stroke of the piston members associated with the outer members 240A–D. Since the length of the stroke of each of the pistons is equal to the difference between the major diameter D and the minor diameter *d* of the elliptical members included in the drive mechanism 200, the inclusion of the plurality of elliptical members 250A–D in series with the members 240A–D doubles the resulting piston stroke. As compared to the mechanism 100, where the stroke is D–*d*, the resulting stroke of the pistons in the mechanism 200 is doubled to 2(D–*d*). The invention thereby provides a simple method of adjusting the piston stroke to suit particular transducer applications.

Figure 6:
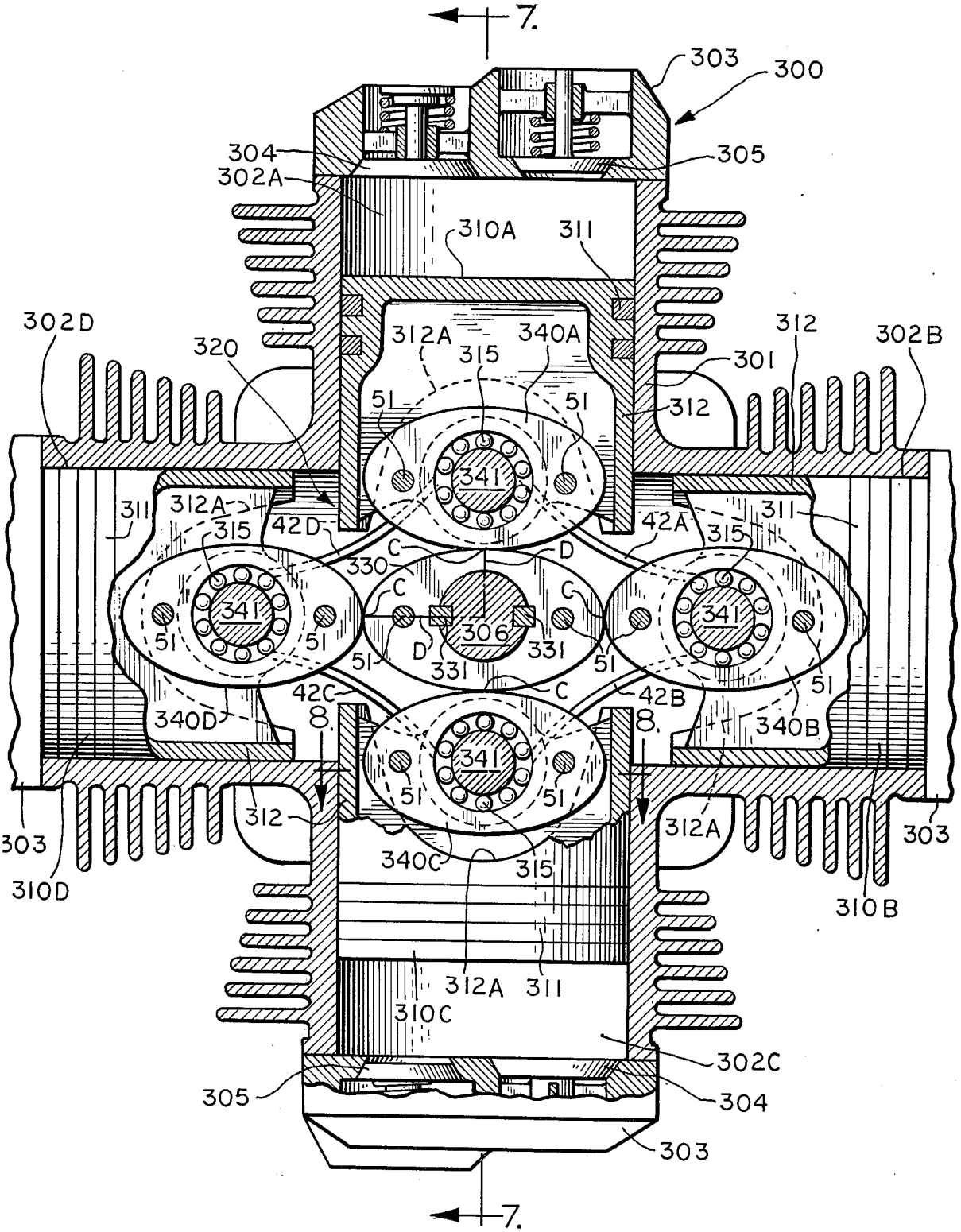
FIG. 6 is a cross-sectional elevational view of an opposed piston compressor embodying the elliptical drive mechanism of the present invention.

FIGS 6 and 7 illustrate the elliptical cam drive mechanism in accordance with this invention embodied within an opposed piston compressor 300. The compressor 300 includes a housing 301 defining four opposed compression cylinders 302A–D. A cylinder head 303 closes the outer open end of each cylinder 302 A–D. Suitable valving, such as a spring-loaded poppet intake valve 304 and poppet exhaust valve 305, are provided in each of the cylinder heads 303 to control the flow of fluid to and from the compressor cylinders 302A–D. A power input shaft 306 is centrally disposed in the compressor 300, and is supported in the walls of the housing 301 in bearings 307. The shaft 306 includes a key-way 308 or other suitable means to connect the shaft to an external power source (not shown).

As seen in FIGS. 6 and 7, a plurality of reciprocating pistons 310A–D are positioned within the piston cylinders 302A–D. Each of the pistons 310A–D includes piston rings 311, for sealing the cylinders. Each of the pistons 310A–D also includes a skirt portion 312 which extends downwardly toward the input shaft 306. The piston skirt 312 have opposed recesses 312A to provide operating space for the elliptical drive mechanism in accordance with this invention.

Each of the pistons 310A–D further includes a pair of inwardly extending support flanges 313. As seen in FIG. 7, the flanges 313 include a bore 314 for receiving a wrist pin 341. The bores 314 are arranged on the associated pistons 310 A–D so that the wrist pins 341 are centered along the axial centerlines of the pistons. Furthermore, as seen in FIG. 6, the bores 314 are in the same position on each of the pistons so that the wrist pins 341 are supported in the same location on each piston with respect to the central shaft 306.

The elliptical drive mechanism incorporated within the compressor 300 is generally indicated by the reference numeral 320 in FIG. 6. The drive mechanism 320 includes a main drive cam 330 connected to the central shaft 306 by keys 331. The drive cam 330 therefore rotates in unison with the input shaft 306. Rotatable and reciprocatory driven cams 340 A–D are uniformly spaced around the main drive cam 330. As seen in FIG. 6, the driven cams 340 A–D are pivotally supported for rotation on the wrist pins 341 provided on the pistons 310 A–D by suitable needle bearings 315. The wrist pin connection also causes the pistons 310 A–D and the cams 340 A–D to reciprocate in unison.

The drive mechanism 320 also includes four spaced pairs of strap links 42 A–D joined between adjacent wrist pins 341. Suitable bearings 43 pivotally support each strap link on the wrist pins 341 so that the links may freely rotate on the pins. Each of the strap links 42 A–D is made from preformed spring steel or the like, so that the links apply a slight inward preloading force to each of the connected wrist pins 341 and pistons 310 A–D.

As illustrated in FIGS. 7, 8 and 10, each of the cams 330 and 340A–D includes elliptical roller gearing 50. As shown in FIGS. 7 and 8, the gearing 50 is preferably laminated between separable halves of each of the cams 330 and 340A–D and is secured in place by connecting pins 51. As explained above, the pitch line P for the gearing 50 in the illustrated embodiment coincides with the elliptical contour of each of the associated cams 330 and 340A–D.

In accordance with this invention, the cams 330 and 340A–D of the drive mechanism 320 are true ellipses having the same major and minor diameters and therefore the same external elliptical cam contours. Furthermore, as shown in FIGS. 6 and 7, the cams 340A–D are arranged in camming engagement with the main cam 330, and are synchronized so that the major and minor diameters of the cams 340A–D align with the major and minor diameters of the main cam 330 during the operation of the drive mechanism 320 as explained above with respect to the drive mechanism 100 shown in FIGS. 1–3. The strap links 42A–D maintain the wrist pins 341 equally spaced throughout the operation of the drive mechanism 320, and assist in synchronizing the relative rotation of the cams 330 and 340A–D. In addition, the meshing of the gearing 50 provided on each of the engaged cams 330 and 340A–D synchronizes the cam operation by preventing slippage between the engaged cam surfaces during the operation of the drive mechanism 320.

To operate the compressor 300, the input shaft 306 is rotated at a selected speed by an external power source (not shown). In addition, the intake and exhaust valve 304 and 305 are operated by suitable valve control means, and are connected to standard intake and exhaust manifolds (not shown). As explained with reference to FIGS. 1–3, the rotation of the input shaft 306 rotates the main drive cam 330 at a constant speed. The rotation of the drive cam 330 in turn causes the periphery of the cam 330 to frictionally engage the peripheries of the cams 340 A–D.

The motion of the cam 330 thereby imparts a rotary motion to each of the engaged cams 340 A–D. Throughout the rotation of the engaged cams 330 and 340 A–D, the contact points C between the cams 340 *a–d* and 330 will vary from the minimum inward location, defined by the engagement of the minor elliptical diameters *d*, to the maximum outward location defined by the engagement of the major elliptical diameters D. As the main cam 330 rotates, the strap links 42 A–D and the gearing 40 assures that the cams 340 A–D maintain the proper position in rolling engagement with the periphery of the main cam 330. The continuous rotation of the cam 330 therefore urges the two opposed pistons 310A and 310C outwardly through a compression stroke equal to *D–d*, to thereby compress the fluid contained within the cylinders 302A and 302C. Simultaneously the rotation of the main cam 330 permits the strap links 42 A–D to draw the other opposed pistons 310B and 310D inwardly through the same stroke. The pistons 310B and 310D are thereby drawn inwardly through a suction stroke, and draw fluid into the chambers 302B and 302D through the intake valves 304.

Accordingly, one pair of opposed pistons in the compressor 300 is driven through a compression stroke at the same time that the other pair of opposed pistons is driven through a suction stroke. This cycle of operation is repeated twice for each complete revolution of the main cam 330.

FIGS. 11 and 12 illustrate another embodiment of the present invention adapted for use in a four-cycle internal combustion engine 400. The engine 400 includes a housing 401 which defines four uniformly spaced and radially opposed piston chambers 402A–D. Each of the cylinders 402 A–D is closed by a cylinder head 403. Suitable intake valves 404, exhaust valves 405, and a spark plug 406 are included in each cylinder head 403. The housing 401 also defines intake and exhaust manifolds 407 and 408 respectively. The intake manifolds 407 are connected to the intake valves 404 of two adjacent cylinders (e.g. 402A and 402D). Similarly, the exhaust manifolds 408 are connected in fluid communication with the exhaust valves 405 of two adjacent cylinders (e.g. 402A and 402B).

The housing 401 of the internal combustion engine 400 also supports a central, rotatable output shaft 409 on suitable bearings (not shown). The shaft 409 extends beyond the housing 401 and is adapted for connection to a load to be driven by the engine 400.

A plurality of reciprocating pistons 410A–D are positioned within the cylinders 402A–D. Each piston is sealed in the cylinder by piston rings, and includes an extended skirt portion 412. Opposed recesses 412A in each skirt 412 provide operating space for the elliptical drive mechanism of this invention. As described above with respect to the compressor 300, each piston 410A–D in the engine 400 supports a centrally located write pin 441.

The elliptical drive mechanism for the engine 400 is generally designated in FIG. 11 by the reference numeral 420. The drive mechanism 420 includes a main output cam 430 which is keyed for rotation with the output shaft 409. A plurality of rotatable and reciprocatory cams 440A–D are arranged uniformly in the engine 400 and camming engagement with the output cam 430. The cams 440A–D are pivotally supported on the wrist pins 441 so that one cam is associated with each piston 410A–D. As described above, spaced pairs of strap links 42A–D join the adjacent wrist pins 441, and preferably apply a slight inward pre-loading force to the pistons 410A–D. Each of the cams 430 and 440 A–D further include the elliptical rolling gearing 50, such as illustrated in FIGS. 8 and 10.

The cams 430 and 440A–D in the drive mechanism 420 are true ellipses having the same major and minor diameters. Also, the cams are arranged in the engine 400 so that relative rotation of the cams aligns the major and minor cam diameters, as described above. The cams 430 and 440A–D thereby rotate in camming engagement with the relative rotation of the cams guided and synchronized by the links 42 and the gearing 50.

The operation of the engine 400 is begun in the usual manner by cranking a flywheel or the like, to introduce an appropriate air-fuel mixture into two of the opposed cylinders, such as cylinders 402A and 402C. Then, a conventional ignition and timing system (not shown) fires the spark plugs 406 to ignite the compressed air fuel mixture in the charged cylinders 402A and 402C. The explosive charges force the associated pistons 410A and 410C inwardly through a power stroke. This inward reciprocation of the pistons is transmitted through the wrist pins 441 to the connected reciprocatory cams 440A and 440C. The inward reciprocation of the cams 440A and 440C causes the cams to frictionally roll along the cam profile of the engaged driven cam 430, and thereby imparts rotary motion to the cam 430 and the output shaft 409.

As seen from FIG. 11, the two cams 440A and 440C apply balanced drive forces to the driven cam 430 from opposite directions, as the pistons 410A and 410 move inwardly through a stroke equal to the difference between the major and minor diameters of the cams 430 and 440A–D.

The above-described rotation of the driven cam 430 simultaneously causes the cam 430 to frictionally engage and rotate the other opposed cams 440B and 440D. The drive mechanism 420 thereby drives the cams 440B and 440D, and the connected pistons 410B and 410D through an outward compression stroke as the other pistons 410A and 410C are driven through their power strokes. The strap links 42 A–D and the gearing 50 maintain the cams 430 and 440 A–D in engagement and synchronization throughout the operation of the engine 400.

The cycle of operation is continued by firing the spark plugs 406 associated with the cylinders 402B and 402D, to drive the pistons 410B and 410D inwardly through their power strokes. As the pistons 410B and 410D are driven downwardly, the drive mechanism 420 drives the other pair of opposed pistons 410A and 410C outwardly through their exhaust strokes. The valves 405 open to exhaust the spent gases from the cylinders 402A and 402C into the connected exhaust manifolds 408.

This above-described sequential operation of the engine 400 continues as each piston 410 A–D travels through a complete cycle of intake, compression, power and exhaust strokes each revolution of the output shaft 409. The drive mechanism 420 thereby converts the reciprocatory motion of the pistons 410A–D into a rotary power output of the shaft 409.

Although the invention has been described with a certain degree of particularity, it should be understood that the present disclosure has been made only by way of example. Consequently, numerous changes in the details of construction and the combination and arrangement of components as well as the possible modes of utilization will be apparent to those familiar with the art, and may be resorted to without departing from the spirit and scope of the invention as claimed.

What is claimed is:

1. A fluid transducer for imparting energy to or receiving energy from a fluid comprising:

central rotary shaft means;

a plurality of reciprocatory piston members disposed around said central shaft means within piston cylinders;

a first elliptical member having selected major and minor diameters and positioned within said transducer for rotation about its elliptical center as said shaft member rotates;

a plurality of second elliptical members having substantially the same major and minor diameters as the first elliptical member, each of said second elliptical members being mounted in said transducer to rotate about its elliptical center and to reciprocate in response to the reciprocation of one of said piston members;

said second elliptical members being arranged in engagement with said first elliptical member so that said first and second elliptical members rotate in unison with constant angular velocity as said piston members and said second elliptical members reciprocate with respect to said rotary shaft means; and means to retain said second elliptical members in said engagement with said first elliptical member whereby said drive mechanism transmits motion between said pistons and said rotary shaft means.

2. A fluid transducer in accordance with claim 1 wherein said means to retain second elliptical members in engagement with said first elliptical member comprises pivotal linking means joining the elliptical centers of second elliptical means.

3. The fluid transducer in accordance with claim 1 wherein each of said second elliptical members is rotatably mounted on one of said piston members for reciprocation with the connected piston member.

4. The fluid transducer in accordance with claim 1 wherein said transducer includes a plurality of third elliptical members positioned within said transducer, said third elliptical members having the same major and minor diameters as said first and second elliptical members and being arranged to rotate about their elliptical centers in engagement with said first and second elliptical members and to reciprocate within said transducer with respect to said first and second elliptical members in response to the reciprocation of said piston members, whereby said third elliptical members increase the resulting reciprocating strokes of said piston members.

5. A fluid transducer in accordance with claim 1 wherein the rotation of said elliptical members is synchronized so that the major and minor diameters of said second elliptical members align with the major and minor diameters of said first elliptical member during the operation of said transducer, whereby said elliptical members transmit motion between said piston members and said rotary shaft means without substantial relative rotational acceleration or deceleration between said elliptical members.

6. The fluid transducer in accordance with claim 1 including means to synchronize the relative rotation of first and second elliptical members comprising gearing means provided on the engageable peripheries of each of said first and second elliptical members which mesh to maintain said elliptical members synchronized as said piston members reciprocate with respect to said rotary shaft means.

7. The invention in accordance with claim 6 wherein said piston members reciprocate in response to the force of a fluid pressure applied thereto so that said elliptical members convert the reciprocation of said pistons into rotary motion of said shaft means.

8. The invention in accordance with claim 6 wherein said rotary shaft means rotates in response to an external rotary force applied thereto and said elliptical members convert said rotary force into reciprocatory motion of piston members to impart energy to a fluid through said piston members.

9. In a fluid transducer including a reciprocatory piston member and a rotary member, a drive mechanism for operatively connecting said piston member to said rotary member comprising:

a first elliptical member having selected major and minor diameters and fixed for rotation with said rotary member;

a second elliptical member having substantially the same major and minor diameters as said first eiliptical member and mounted in said transducer to rotate and to reciprocate with respect to said first elliptical member as said piston member reciprocates;

a third elliptical member having the same major and minor diameters as said first and second elliptical members and intermediately positoned in engagement with said first and second elliptical members, said third elliptical member reciprocating with respect to said first and second elliptical members and rotating with said first and second elliptical members to transmit motion between said first and second elliptical members; and means to retain said first, second and third elliptical members in engagement as said piston member and said second and third elliptical members reciprocate;

said elliptical members being arranged in said transducer to rotate together in said engagement with constant angular velocity as said piston member and said second and third elliptical members reciprocate with respect to said rotary member, so that the rotation of one of said elliptical members imparts rotary motion to the engaged elliptical member;

whereby said drive mechanism transmits motion between said piston and rotary members and said third elliptical member increases the resulting stroke of said piston member.

* * * * *